US009891559B2

(12) United States Patent
Takenaka et al.

(10) Patent No.: US 9,891,559 B2
(45) Date of Patent: Feb. 13, 2018

(54) TRANSFER APPARATUS AND IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Sunao Takenaka, Yokohama Kanagawa (JP); Suguru Kurita, Mishima Shizuoka (JP); Koichiro Sato, Mishima Shizuoka (JP); Koji Takahashi, Sumida Tokyo (JP); Kazufumi Ishida, Sunto Shizuoka (JP); Yoshiki Kogiso, Mishima Shizuoka (JP); Takehiro Meguro, Hiratsuka Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/982,468

(22) Filed: Dec. 29, 2015

(65) Prior Publication Data

US 2017/0185004 A1 Jun. 29, 2017

(51) Int. Cl.
*G03G 15/16* (2006.01)
*G03G 15/00* (2006.01)

(52) U.S. Cl.
CPC ..... *G03G 15/162* (2013.01); *G03G 15/1685* (2013.01); *G03G 15/6594* (2013.01)

(58) Field of Classification Search
CPC ..... G03G 15/1675; G03G 15/1685
USPC ..... 399/313, 314
See application file for complete search history.

(56) References Cited

U.S. PATENT DOCUMENTS 5,450,180 A * 9/1995 Ohzeki ..... G03G 15/1675 399/314
5,646,717 A * 7/1997 Hiroshima ..... G03G 15/0266 399/10
5,732,314 A * 3/1998 Tsukida ..... G03G 15/162 399/302
5,794,110 A 8/1998 Kasai et al.
6,397,030 B1 * 5/2002 Watanabe ..... G03G 15/161 399/237
2004/0190919 A1 * 9/2004 Iwasaki ..... G03G 15/1675 399/45

(Continued)

*Primary Examiner* — Erika J Villaluna
(74) *Attorney, Agent, or Firm* — Amin, Turocy & Watson LLP; Gregory Turocy

(57) ABSTRACT

Certain embodiments provide a transfer apparatus, which including: an conductive intermediate transfer member; a transfer section configured to secondarily transfer a toner image onto an image receiving medium in a constant current system; a conveyance section configured to convey the image receiving medium; and a high voltage transformer configured to apply a bias to the transfer member, wherein the sum of the products of the volume resistivities [Ω·cm] and the thicknesses [cm] of the intermediate transfer member and the transfer member is equal to or greater than $3.6\times10^8$ Ω·cm$^2$, and the conveyance speed V[mm/s] of the image receiving medium={the output upper limit value A[V] of the absolute value of the voltage output from the transfer polarity side of the high voltage transformer}× 0.009.

10 Claims, 11 Drawing Sheets

(56) References Cited

U.S. PATENT DOCUMENTS

| | | | | |
|---|---|---|---|---|
| 2004/0240915 | A1* | 12/2004 | Nakayama | G03G 21/0017 399/345 |
| 2009/0202281 | A1* | 8/2009 | Doda | G03G 15/1605 399/313 |

* cited by examiner

FIG.6A

| | VOLUME RESISTIVITY [Ω·cm ] | RESISTIVE LAYER THICKNESS [cm ] | VOLUME RESISTIVITY × RESISTIVE LAYER THICKNESS [Ω·cm² ] |
|---|---|---|---|
| SECONDARY TRANSFER ROLLER | 4.80E+08 | 0.6 | 2.88E+08 |
| INTERMEDIATE TRANSFER BELT | 1.00E+10 | 0.007 | 7.00E+07 |
| TOTAL | | | 3.58E+08 |

FIG.6B

| | VOLUME RESISTIVITY [Ω·cm ] | RESISTIVE LAYER THICKNESS [cm ] | VOLUME RESISTIVITY × RESISTIVE LAYER THICKNESS [Ω·cm² ] |
|---|---|---|---|
| SECONDARY TRANSFER ROLLER | 2.10E+09 | 0.6 | 1.26E+09 |
| INTERMEDIATE TRANSFER BELT | 1.00E+10 | 0.007 | 7.00E+07 |
| TOTAL | | | 1.33E+09 |

FIG.6C

| | VOLUME RESISTIVITY [Ω·cm ] | RESISTIVE LAYER THICKNESS [cm ] | VOLUME RESISTIVITY × RESISTIVE LAYER THICKNESS [Ω·cm² ] |
|---|---|---|---|
| SECONDARY TRANSFER ROLLER | 3.00E+08 | 0.6 | 1.80E+08 |
| INTERMEDIATE TRANSFER BELT | 1.00E+10 | 0.007 | 7.00E+07 |
| SECONDARY TRANSFER OPPOSITE ROLLER | 1.00E+10 | 0.05 | 5.00E+08 |
| TOTAL | | | 7.50E+08 |

| | SECONDARY TRANSFER ROLLER | TRANSFER BELT | SECONDARY TRANSFER OPPOSITE ROLLER | TOTAL OF [VOLUME RESISTIVITIES ×THICKNESSES] | PROCESSING SPEED | LOWEST ID | MAXIMUM VOLTAGE |
|---|---|---|---|---|---|---|---|
| EXAMPLE 1 | 4.8E+08 Ω·cm | 1.0E+10 Ω·cm | - | 3.6E+08 Ω·cm2 | 50mm/s | O(1.39) | -1890V |
| | THICKNESS= 0.6cm | THICKNESS= 0.007cm | | | | | |
| EXAMPLE 2 | 2.1E+09 Ω·cm | 1.0E+10 Ω·cm | - | 1.3E+09 Ω·cm2 | 50mm/s | O(1.41) | -2200V |
| | THICKNESS= 0.6cm | THICKNESS= 0.007cm | | | | | |
| EXAMPLE 2-1 (cf1) | 2.1E+10 Ω·cm | 1.0E+10 Ω·cm | - | 1.3E+10 Ω·cm2 | 50mm/s | O(1.41) | -5700V |
| | THICKNESS= 0.6cm | THICKNESS= 0.007cm | | | | | |
| EXAMPLE 2-2 (cf2) | 2.1E+10 Ω·cm | 1.0E+10 Ω·cm | - | 1.3E+10 Ω·cm2 | 75mm/s | x(cf3) | x(cf4) |
| | THICKNESS= 0.6cm | THICKNESS= 0.007cm | | | | | |
| EXAMPLE 3 | 2.1E+10 Ω·cm | 1.0E+10 Ω·cm | - | 1.3E+10 Ω·cm2 | 30mm/s | O(1.41) | -3300V |
| | THICKNESS= 0.6cm | THICKNESS= 0.007cm | | | | | |
| EXAMPLE 4 | 3.0E+08 Ω·cm | 1.0E+10 Ω·cm | 1.0E+10 Ω·cm | 7.5E+8 Ω·cm2 | 50mm/s | O(1.40) | -2100V |
| | THICKNESS= 0.6cm | THICKNESS= 0.007cm | THICKNESS= 0.05cm | | | | |

cf1: L/L ENVIRONMENT AFTER LONG-USED IN EXAMPLE 2
cf2: CASE OF SPEED 75mm/S IN EXAMPLE 2-1
cf3: CASE OF OHP SHEET, VOLTAGE CAPACITY EXCEEDS UPPER LIMIT VALUE
cf4: ABSOLUTE VALUE OF VOLTAGE IS EQUAL TO OR GREATER THAN 8000V

FIG.10A

| | SECONDARY TRANSFER ROLLER | TRANSFER BELT | SECONDARY TRANSFER OPPOSITE ROLLER | TOTAL OF [VOLUME RESISTIVITIES ×THICKNESSES] | PROCESSING SPEED | LOWEST ID | MAXIMUM VOLTAGE |
|---|---|---|---|---|---|---|---|
| SUPPLEMENTAL EXAMPLE 1 | 6.0E+08 Ω·cm<br>THICKNESS= 0.5cm | 1.0E+10 Ω·cm<br>THICKNESS= 0.007cm | - | 3.7E+08 Ω·cm2 | 50mm/s | O(1.39) | -1890V |
| SUPPLEMENTAL EXAMPLE 2 | 4.0E+08 Ω·cm<br>THICKNESS= 0.8cm | 1.0E+10 Ω·cm<br>THICKNESS= 0.007cm | - | 3.9E+8 Ω·cm2 | 50mm/s | O(1.39) | -1900V |
| SUPPLEMENTAL EXAMPLE 3 | 6.0E+08 Ω·cm<br>THICKNESS= 0.6cm | 1.2E+09 Ω·cm<br>THICKNESS= 0.007cm | - | 3.7E+8 Ω·cm2 | 50mm/s | O(1.39) | -1895V |
| SUPPLEMENTAL EXAMPLE 4 | 4.0E+08 Ω·cm<br>THICKNESS= 0.6cm | 1.6E+10 Ω·cm<br>THICKNESS= 0.008cm | - | 3.7E+8 Ω·cm2 | 50mm/s | O(1.39) | -1910V |
| SUPPLEMENTAL EXAMPLE 5 | 3.0E+08 Ω·cm<br>THICKNESS= 0.6cm | 1.0E+10 Ω·cm<br>THICKNESS= 0.007cm | - | 2.5E+8 Ω·cm2 | 50mm/s | Δ (1.30) | -1855V |
| SUPPLEMENTAL EXAMPLE 6 | 4.8E+08 Ω·cm<br>THICKNESS= 0.6cm | 1.0E+09 Ω·cm<br>THICKNESS= 0.007cm | - | 3.0E+8 Ω·cm2 | 50mm/s | Δ (1.32) | -1860V |
| SUPPLEMENTAL EXAMPLE 7 | 2.0E+08 Ω·cm<br>THICKNESS= 0.6cm | 1.0E+09 Ω·cm<br>THICKNESS= 0.007cm | - | 1.3E+8 Ω·cm2 | 50mm/s | x (1.26) | -1800V |

FIG.10B

TRANSFER APPARATUS AND IMAGE FORMING APPARATUS

TECHNICAL FIELD

Embodiments descried herein relate generally to a transfer apparatus and an image forming apparatus.

BACKGROUND

In recent years, an image forming apparatus using an electrophotographic technology is functionally required to be capable of printing on a variety of image receiving media.

The image receiving medium, referring to a medium, is a printed medium such as a sheet or an OHP (overhead projector) film.

In the image forming apparatus, a transfer condition is changed with the material type and the thickness of a medium. The image forming apparatus prepares different modes for different media in advance according to different transfer conditions.

The modes refer to print modes. The image forming apparatus provides a mode for printing on a medium having a standard thickness or a mode for printing on a medium thicker or thinner than the standard thickness.

The image forming apparatus switches to a transfer condition proper for a medium according to the mode selected by the user on a control panel.

In methods for switching between transfer conditions, if the current medium meets the transfer condition assumed in a selected mode, then a user-desired transfer quality can be achieved.

However, a medium not assumed according to the selected mode is set by the image forming apparatus in the mode. A transfer job is carried out on the medium under a transfer condition different from that for the mode. Consequentially, no excellent transfer performance is achieved by the image forming apparatus.

Alternatively, the user mistakenly selects a button which corresponds to the type of the image receiving medium. Because of the error operation of the user, the image forming apparatus prints in a medium mode not corresponding to type of the image receiving medium. Consequentially, no accurate transfer performance is achieved by the image forming apparatus.

If a transfer apparatus cannot exert a transfer performance accurately, then an image forming apparatus cannot form an optimal image.

DESCRIPTION OF THE DRAWINGS

FIG. 6A is a diagram illustrating the condition of the volume resistivity and the resistive layer thickness of each transfer member and the product of the volume resistivity and the resistive layer thickness according to an example 1;

FIG. 6B is a diagram illustrating the condition of the volume resistivity and the resistive layer thickness of each transfer member and the product of the volume resistivity and the resistive layer thickness according to an example 2;

FIG. 6C is a diagram illustrating the condition of the volume resistivity and the resistive layer thickness of each transfer member and the product of the volume resistivity and the resistive layer thickness according to an example 4;

FIG. 10A and FIG. 10B are diagrams separately presenting the results achieved by combining the elements of various transfer members.

DETAILED DESCRIPTION

Certain embodiments provide a transfer apparatus, including: a conductive intermediate transfer member configured to transfer a toner image primarily; a transfer member configured to secondarily transfer the toner image from the intermediate transfer member onto an image receiving medium in a constant current system; a conveyance section configured to convey the image receiving medium between the intermediate transfer member and the transfer member; and a high voltage transformer configured to apply a bias to the transfer member, wherein the sum of the products of the volume resistivities [Ω·cm] and the thicknesses [cm] of the intermediate transfer member and the transfer member is equal to or greater than $3.6\times10^8$ Ω·cm$^2$, moreover, when the output upper limit value of the absolute value of the voltage output from the transfer polarity side of the high voltage transformer is set to be A[V] and the conveyance speed of the image receiving medium be V[mm/s], the speed V is equal to or smaller than a speed calculated according to the following formula (i):

$$V=A\times0.009 \qquad \text{formula (i).}$$

Certain embodiments provide an image forming apparatus including: a developing device configured to form a toner image on an image carrier; a conductive intermediate transfer member configured to primarily transfer the toner image formed by the developing device; a transfer member configured to secondarily transfer the toner image from the intermediate transfer member onto an image receiving medium in a constant current system; a conveyance section configured to convey the image receiving medium between the intermediate transfer member and the transfer member; a high voltage transformer configured to apply a bias to the transfer member; and a fixing section configured to fix the toner image on the image receiving medium, wherein the sum of the products of the volume resistivities [Ω·cm] and the thicknesses [cm] of the intermediate transfer member and the transfer member is equal to or greater than $3.6\times10^8$ $\Omega\cdot cm^2$, moreover, when the output upper limit value of the absolute value of the voltage output from the transfer polarity side of the high voltage transformer is set to be A[V] and the conveyance speed of the image receiving medium be V[mm/s], the speed V is equal to or smaller than a speed calculated according to the following formula (i):

$$V=A\times0.009 \quad \text{formula (i).}$$

First Embodiment

Figure 1:
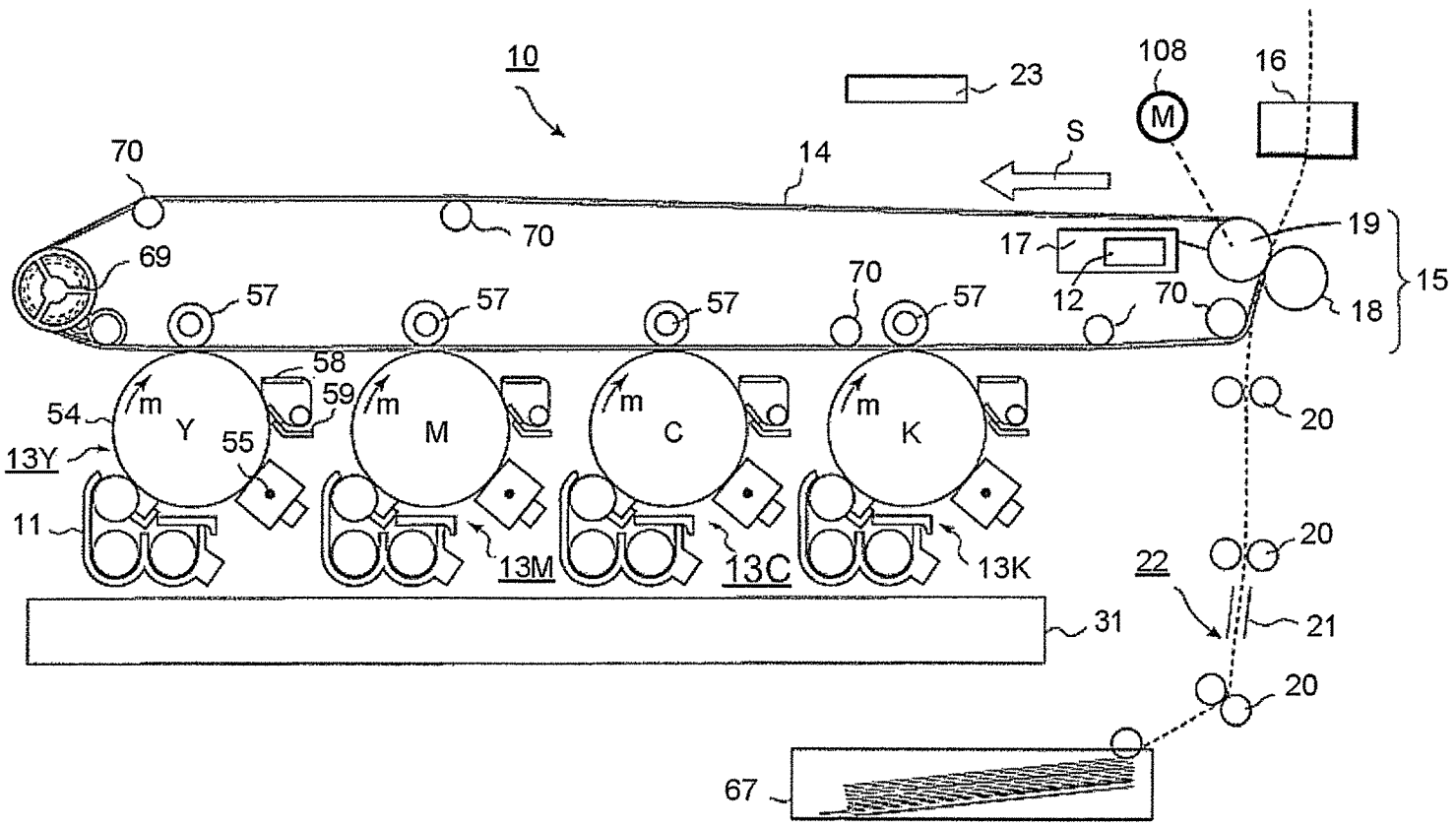
FIG. 1 is a diagram illustrating the structure of an image forming apparatus according to an embodiment.

FIG. 1 is a diagram illustrating the structure of an image forming apparatus according to a first embodiment.

The image forming apparatus according to the present embodiment is a color copier 10.

The transfer apparatus according to the present embodiment is a secondary transfer section 15.

The copier 10 comprises developing devices 11 for different colors, an intermediate transfer belt 14 (intermediate transfer member), a secondary transfer section 15, a conveyance section 22, a secondary transfer constant-current transformer (high voltage transformer) 12 and a fixing section 16.

The developing devices 11 for different colors form toner images on corresponding photoconductive drums 54 (image carriers).

The intermediate transfer belt 14 which is conductive primarily transfers the toner image from the photoconductive drum 54 onto a belt surface.

The secondary transfer section 15 secondarily transfers the toner image from the intermediate transfer belt 14 onto a medium (an image receiving medium) in a constant-current system. The secondary transfer section 15 comprises a secondary transfer roller (a transfer member) 18 and a secondary transfer opposite roller (a transfer member) 19.

The conveyance section 22 conveys a medium between the intermediate transfer belt 14 and the secondary transfer section 15.

The secondary transfer constant-current transformer 12 is a high-voltage constant-current transformer which applies a bias having the same polarity with the toner image to the secondary transfer section 15.

If the toner is a negative charge and a secondary transfer bias is applied from the side of the secondary transfer opposite roller 19, then the transfer polarity is 'negative'.

The fixing section 16 fixes the toner image on the medium.

The sum of the products of the volume resistivities [Ω·cm] and the thicknesses [cm] of the intermediate transfer belt 14, the secondary transfer roller 18 and the secondary transfer opposite roller 19 is equal to or greater than $3.6\times10^8$ $\Omega\cdot cm^2$. Moreover, when the output upper limit value of the absolute value of the voltage output from the transfer polarity side of the secondary transfer constant-current transformer 12 is set to be A[V] and the conveyance speed of the medium be V[mm/s], the speed V is equal to or smaller than the speed calculated according to the following formula:

$V=A\times0.009$, in which "×" represents multiplication.

In FIG. 1, the copier 10 comprises image forming sections 13Y, 13M, 13C and 13K, an exposure device 31, an intermediate transfer belt 14 and a controller 23.

The image forming sections 13Y, 13M, 13C and 13K form yellow (Y), magenta (M), cyan (C) and black (K) images, respectively.

The image forming section 13Y comprises a photoconductive drum 54 (an image carrier), a charger 55, a developing device 11, a primary transfer device 57, a cleaner 58 and a charge removing device 59.

The photoconductive drum 54 rotates along a clockwise direction m.

The charger 55 charges the surface of the photoconductive drum 54.

The developing device 11 develops, with the use of a toner, an electrostatic latent image formed on the photoconductive drum 54.

Figure 2:
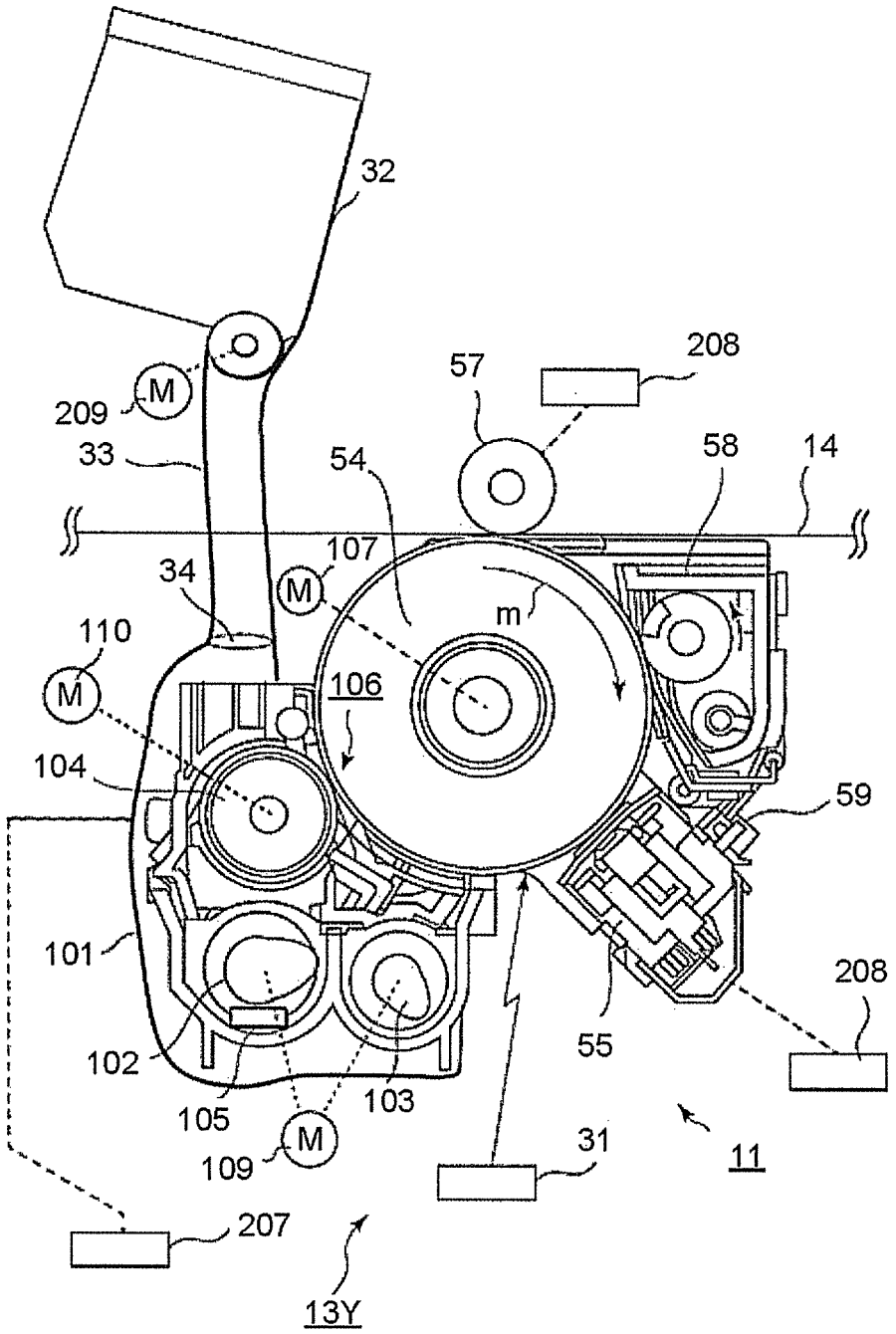
FIG. 2 is a diagram illustrating the peripheral devices of a developing device of the image forming apparatus according to the embodiment.

FIG. 2 is a diagram illustrating the peripheral devices of the developing device 11. The reference signs described above denote the same elements in FIG. 2.

Mixers 102 and 103, a magnetic roller (magnet roller) 104 and a toner sensor 105 are arranged in a container 101 of the developing device 11.

The container 101 is filled with a two-component developing agent (toner particles and carrier particles). The container 101 supplies a toner from a toner cartridge 32 through a path 33 and a receiving opening 34.

The mixers 102 and 103 circulate the developing agent in the container 101. The mixers 102 and 103 charge the toner particles and the carrier separately with negative charges and positive charges.

The mixer 102 comprises an auger having helical blades, a paddle formed by assembling a plurality of frames and rotating coaxially with the auger and a motor for rotating the auger and the paddle. The mixer 103 is the same as the mixer 102 in the structure.

The magnetic roller 104 is a developing roller. The magnetic roller 104 comprises a cylindrical sleeve and a plurality of magnets arranged inside the sleeve. The magnetic roller 104 contacts a magnetic brush with the photoconductive drum 54 through an opening 106.

Different from the motor 110 of the magnetic roller 104, the developing device 11 comprises motors 109 of the mixers 102 and 103.

The toner sensor 105 detects the density of the toner stirred by the mixers 102 and 103. An ATS (automatic toner sensor) is used in the toner sensor 105. The toner sensor 105 outputs a smaller voltage when the density of the toner in the developing agent increases.

A primary transfer device 57 is a primary transfer roller. The primary transfer device 57 applies a primary transfer voltage to the intermediate transfer belt 14. The polarity of the primary transfer voltage is reverse to that of the toner image.

The cleaner 58 removes the toner. The charge removing device 59 removes the charges on the photoconductive drum 54.

The copier 10 comprises four drum motors 107 (only one is shown in FIG. 2) which rotate the photoconductive drums 54, respectively.

The copier 10 comprises the developing motors 109 for respectively rotating the mixers 102 and 103 and a magnetic roller motor 110 for rotating the magnetic roller 104.

In FIG. 1, the image forming sections 13M, 13C and 13K substantially have the same structure with the image forming section 13Y.

The exposure device 31 forms electrostatic latent images separately on the four photoconductive drums 54 using a laser emitting element or an LED (Light Emitting Diode).

The intermediate transfer belt 14 overlaps Y, M, C and K toner images sequentially on a belt surface.

The intermediate transfer belt 14 advances endlessly along the S direction. The intermediate transfer belt 14 is applied with a tension by means of the second transfer opposite roller 19 and a plurality of tension rollers 70.

Further, the copier 10 comprises the conveyance section 22, the secondary transfer section 15 (a transfer member) and the secondary transfer constant-current transformer 12 (high voltage transformer).

The conveyance section 22 comprises a plurality of pairs of rollers 20 and a guide 21. The conveyance section 22 pulls, one by one, media out of a tray 67.

The secondary transfer section 15 secondarily transfers the toner images from the intermediate transfer belt 14 onto a medium (an image receiving medium) in a constant current system.

The secondary transfer section 15 comprises the secondary transfer roller 18 (a transfer roller), the secondary transfer opposite roller 19 (an opposite roller) and a secondary transfer constant current source 17.

Figure 3:
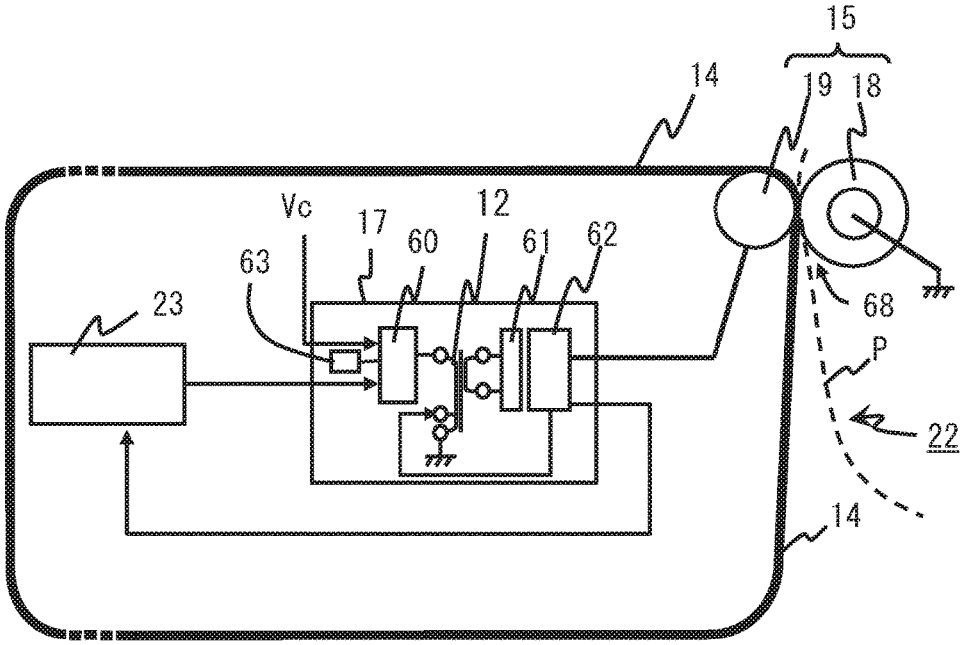
FIG. 3 is a diagram illustrating the structure of a transfer apparatus and a bias power source applying bias to the transfer apparatus according to the embodiment.

FIG. 3 is a diagram illustrating the structures of the secondary transfer section 15 and a bias power source supplying a bias to the secondary transfer section 15. The reference signs described above denote the same elements in FIG. 3.

The secondary transfer section 15 comprises the intermediate transfer belt 14 (an intermediate transfer member), the secondary transfer roller 18 (a transfer member), the secondary transfer opposite roller 19 (a transfer member), the conveyance section 22 and the secondary transfer constant-current transformer 12 (high voltage transformer).

The secondary transfer section 15 clamps a medium and the intermediate transfer belt 14 together using the secondary transfer roller 18 and the secondary transfer opposite roller 19. The secondary transfer opposite roller 19 and the secondary transfer roller 18 are arranged opposite to each other so as to support the intermediate transfer belt 14.

The belt width of the intermediate transfer belt 14 is greater than the roller length of the secondary transfer roller 18. The roller length refers to the length of rubber in the axial direction of the secondary transfer roller 18.

The intermediate transfer belt 14 is structured by adding a conductive agent into a Polyimide (PI) resin having a thickness of 70 μm.

For example, by scattering a carbon, the intermediate transfer belt 14 is endowed with the conductivity. The volume resistivity of the intermediate transfer belt 14 ranges from $10^8$ [Ω·cm] to $10^9$[Ω·cm].

The secondary transfer roller 18 is a cylindrical rubber roller. The secondary transfer roller 18 is made from a blended rubber formed by synthesizing a hydrin rubber (epichlorhydrin rubber) and a NBR (Nitrile Butadiene Rubber).

The hydrin rubber is used to adjust the resistance value of the secondary transfer roller 18 by adding an ion conductive agent into a polar polymer.

The secondary transfer opposite roller 19 additionally functions as a belt driving roller for driving the intermediate transfer belt 14 to advance.

The secondary transfer opposite roller 19 is a cylindrical metal roller (refer to the under-mentioned examples 1-3).

Alternatively, the secondary transfer opposite roller 19 may comprise a metal roller and a resistive layer arranged on the outer circumferential surface of the roller (refer to the under-mentioned example 4). The resistive layer is a hydrin rubber layer. The roller is biased to a negative potential.

The secondary transfer constant current source 17 is as bias power source which applies a secondary transfer bias to the secondary transfer opposite roller 19.

The secondary transfer constant-current transformer 12 applies a bias having the same polarity with the toner image to the secondary transfer section 15.

The controller 23 maintains the current value output from the secondary transfer constant current source 17 to the secondary transfer opposite roller 19 at a specific value.

The secondary transfer constant current source 17 comprises the secondary transfer constant-current transformer 12 and a switching transistor 60 located at the primary side of the secondary transfer constant-current transformer 12. The secondary transfer constant current source 17 comprises a rectifying circuit 61 and a bias circuit 62 which are arranged at the secondary side of the secondary transfer constant-current transformer 12.

The secondary transfer constant current source 17 comprises a resonant circuit 63 at the primary side of the secondary transfer constant-current transformer 12. The secondary transfer constant current source 17 supplies a direct current voltage supplied from a direct current voltage source to the switching transistor 60.

The switching transistor 60 activates the resonant circuit 63 according to an 'On' signal sent from the controller 23. The switching transistor 60 stops activating the resonant circuit 63 according to an 'Off' signal.

The secondary transfer constant-current transformer 12 outputs an alternating voltage by changing the direct current voltage according to the 'On' signal or 'Off' signal of the switching transistor 60.

The rectifying circuit 61 rectifies an alternating voltage signal.

The bias circuit 62 generates a constant current according to the rectified voltage signal. The bias circuit 62 may use the constant current in a bias voltage for measuring the resistance of the second transfer section 15 carrying no medium.

The bias circuit 62 supplies the constant current to the secondary transfer opposite roller 19.

The polarity of the secondary transfer voltage applied to the secondary transfer opposite roller 19 is identical. to that of the toner image. If the charging polarity for a toner is negative, then the controller 23 applies a negative bias to the secondary transfer opposite roller 19.

Further, in FIG. 3, the conveyance section 22 conveys a sheet P to a contact nip 68 located between the intermediate transfer belt 14 and the second transfer roller 18.

The contact nip 68 is a surface area formed through the contact of the outer circumferential surface of the second transfer roller 18 with the surface the side of the intermediate transfer belt 14 at which a toner image is carried. The contact nip 68 has a specific width in a circumferential direction.

The toner image on the intermediate transfer belt 14 moves on the medium as the medium passes the contact nip 68.

Figure 4:
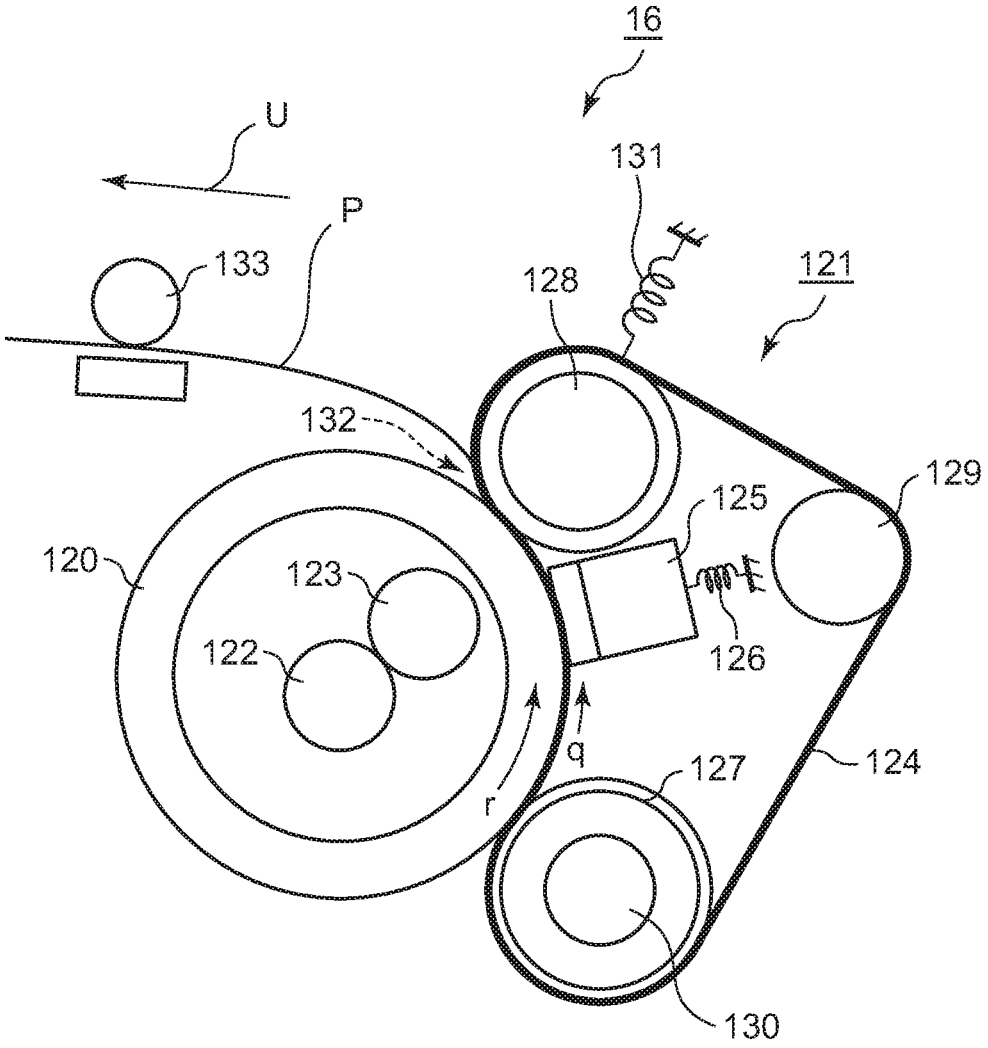
FIG. 4 is a diagram illustrating the structure of a fixing section of the image forming apparatus according to the embodiment.

FIG. 4 is a diagram illustrating the structure of the fixing section 16. The reference signs described above denote the same elements in FIG. 4.

The fixing section 16 fixes the toner image on the medium.

The fixing section 16 comprises a heating roller 120 and a press mechanism 121.

The heating roller 120 comprises heaters 122 and 123. The heaters 122 and 123 are halogen lamps. The heater 122 heats the axial center of the heating roller 120. The heater 123 heats the two sides of the heater 122.

The press mechanism 121 comprises a heating belt 124, a nip pad 125, a spring coil 126, a belt heating roller 127, a press roller 128 and a tension roller 129.

The heating belt 124 advances endlessly and circularly.

The nip pad 125 comprises a sheet metal and silicone rubber coated on the sheet metal.

The spring coil 126 presses the nip pad 125 towards the direction of the heating roller 120.

The belt heating roller 127 preheats the heating belt 124 at the upstream side of the rotation direction q of the heating belt 124.

The belt heating roller 127 comprises a heater 130. The heater 130 is a halogen lamp.

The press roller 128 is located at the downstream side of the rotation direction q. The press roller 128 is pressed towards the direction of the heating roller 120 with a force from a spring coil 131.

The tension roller 129 provides a tension for the heating belt 124.

The fixing section 16 contacts the heating belt 124 located from the nip pad 125 to the press roller 128 with the heating roller 120.

The fixing section 16 rotates the heating roller 120 in a rotation direction r. The fixing section 16 rotates the heating belt 124 in the rotation direction q.

The fixing section 16 heats a medium by lightly clamping the medium using the heating roller 120 and the heating belt 124 at the position of the nip pad 125.

The fixing section 16 presses the medium with a large force at the position of the press roller 128.

The fixing section 16 fixes a toner image on the medium. The fixing section 16 discharges, using a roller 133, the medium on which the toner image is fixed by means of heat and pressure. (U represents the medium (sheet P) discharging direction).

Figure 5:
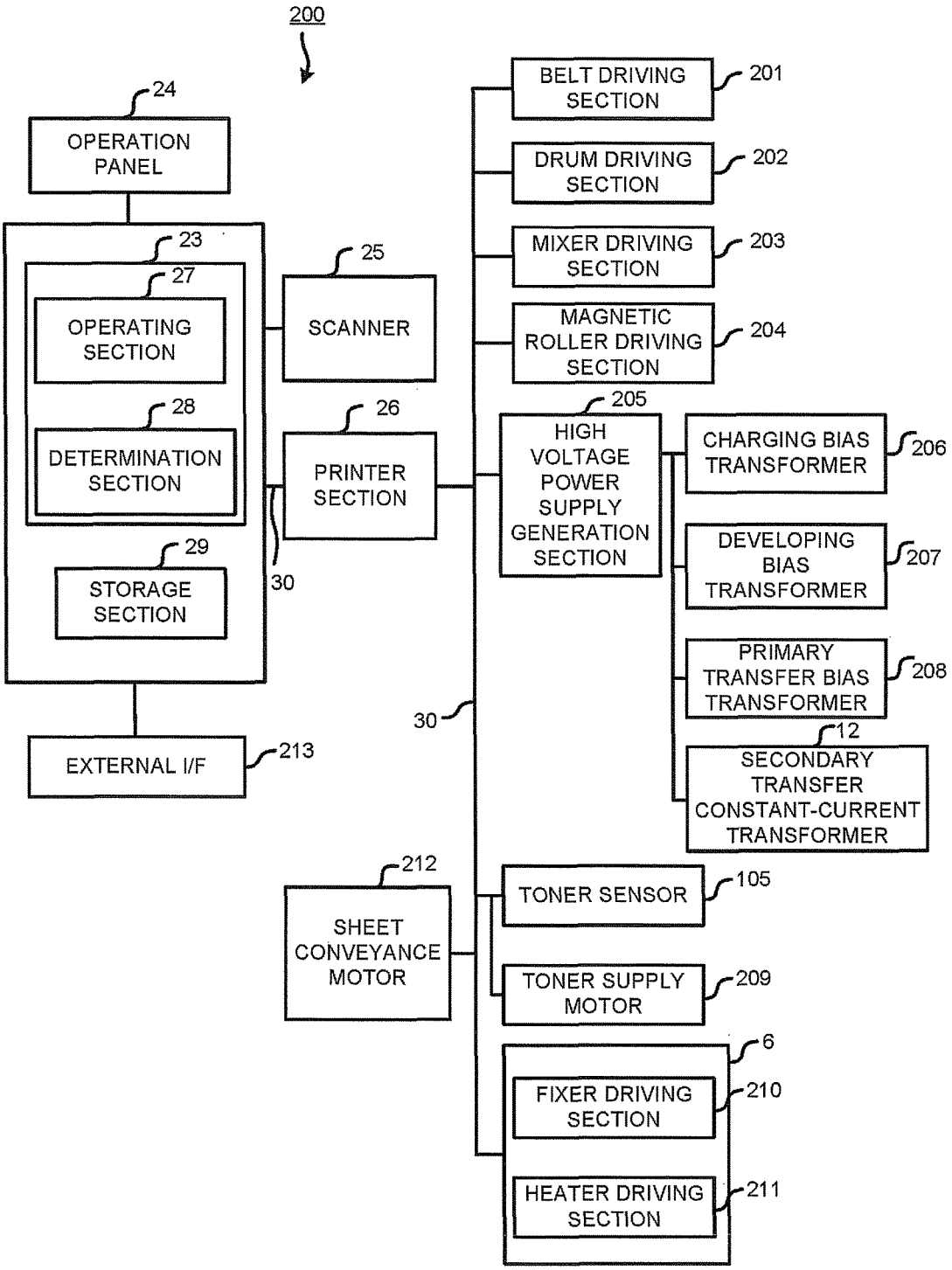
FIG. 5 is a block diagram illustrating a control system of the image forming apparatus according to the embodiment.

FIG. 5 is a block diagram illustrating a control system of the image forming apparatus according to the embodiment. The reference signs described above denote the same elements in FIG. 5.

A control system 200 comprises a belt driving section 201, a drum driving section 202, a mixer driving section (a drive section for the mixer of the developing device) 203 and a magnetic roller driving section 204.

The belt driving section 201 is a driver for a belt motor 108 (FIG. 1). The belt motor 108 rotates the secondary transfer opposite roller 19. The secondary transfer opposite roller 19 advances the intermediate transfer belt 14.

The drum driving section 202 is a driver for four drum motors 107 (FIG. 2).

The mixer driving section 203 is a driver for the developing motor 109.

The magnetic roller driving section 204 is a driver for the magnetic roller motor 110.

The control system 200 comprises a high voltage power supply generation section 205 for generating a variety of high voltage biases.

The high voltage power supply generation section 205 supplies a bias separately to a charging bias transformer 206, a developing bias transformer 207, a primary transfer bias transformer 208 and the secondary transfer constant-current transformer 12 (FIG. 3).

The charging bias transformer 206 is a charging bias power source for four chargers 55.

The developing bias transformer 207 is a developing bias power source for four developing devices 11.

The primary transfer bias transformer 208 is a primary transfer bias power source for four primary transfer devices 57.

The control system 200 comprises toner supply motors 209 arranged in four toner cartridges 32 (only one is shown in FIG. 2).

The control system 200 comprises a sheet conveyance motor 212. The sheet conveyance motor 212 rotates the plurality of pairs of rollers 20.

The control system 200 comprises, inside the fixing section 16 (FIG. 4), a fixer driving section 210 and a heater driving section 211.

The fixer driving section 210 is a driver for the motor of the heating roller 120 and the motor of the press roller 128.

The heater driving section 211 thermally drives each of the heaters 122, 123 and 130.

Further, the control system 200 comprises an operation panel 24 for user operation, a scanner 25 and a printer section 26 for printing and outputting a scanned image.

The printer section 26 functionally consists of the image forming sections 13Y, 13M, 13C and 13K, the exposure device 31, the intermediate transfer belt 14 and the secondary transfer section 15.

The control system 200 comprises an external interface (I/F) 213. The external interface (I/F) 213 is interfaced with an LAN (Local Area Network) and an USB (Universal Serial Bus).

The controller 23 further comprises an operating section 27 and a determination section 28. The functions of the controller 23 are executed by a CPU (Central Processing Unit), an ROM (Read Only Memory) and an RAM (Random Access Memory).

The controller 23 reads various set values from a storage section 29.

The control system 200 electrically connects the controller 23 with a plurality of structural elements of the copier 10 via a bus line 30.

Next, the operations carried out by the copier 10 (FIG. 1) having the foregoing structure are described below.

The copier 10 scans an original document using the scanner 25.

The printer section 26 forms electrostatic latent images respectively on corresponding photoconductive drums 54 according to the scanned image.

The printer section 26 develops electrostatic latent images of four colors using corresponding toners. The printer section 26 forms monochromatic toner images sequentially on the intermediate transfer belt 14.

The conveyance section 22 guides a medium to the secondary transfer section 15. The secondary transfer section 15 transfers the toner images formed on the intermediate transfer belt 14 onto the medium.

Example 1

Example 1 is described below.

As shown in FIG. 1, the copier 10 adopts a representative color tandem intermediate transfer system. Image forming stations for images of four colors are arranged at specific intervals.

As shown in FIG. 2, the developing device 11 comprises a drive system for rotating the magnetic roller 104 and a drive system for rotating the mixers 102 and 103.

The magnetic roller 104 rotates at a low speed, matching with the photoconductive drum 54.

The developing device 11 enables the mixers 102 and 103 to rotate at a speed at a certain level. The certain level refers to a level at which the mixing and conveyance of a developing agent can be continued.

It is set in the example 1 that the surface speed of the magnetic roller 104 is 1.85 times as fast as a processing speed. The rotation frequency of the mixers 102 and 103 is set to be 300 RPM (Revolutions Per Minute).

The secondary transfer section 15 applies a secondary transfer bias from a constant current source to a medium through the secondary transfer opposite roller 19. The constant current source outputs a current having the same polarity with a charging polarity for a toner.

In the example 1, to achieve a print span of 297 mm (the length of the short side of ISO A3), the width of the resistive layer of the secondary transfer roller 18 is about 310 mm.

The resistive layer refers to a resistive component based on the blended rubber of the secondary transfer roller 18.

The outer diameter of the transfer member of the secondary transfer roller 18 is 24 mm, including 6 mm rubber thickness.

The material of the transfer member is a blended rubber composed of hydrin rubber and NBR rubber which is excellent in abrasion resistance.

The intermediate transfer belt 14 wider than the secondary transfer roller 18 uses a belt substrate made from polyimide (PI) which is 70 μm thick. The intermediate transfer belt 14 is conductive.

The secondary transfer opposite roller 19 (a belt driving roller) uses a conductor with an outer diameter of 18 mm.

A transfer bias is applied from the secondary transfer constant current source 17 to the secondary transfer opposite roller 19.

The distance between the shafts of the secondary transfer roller 18 and the secondary transfer opposite roller 19 is fixed under the following two conditions:

Condition 1: in the absence of a medium, the width of the contact nip between the secondary transfer roller 18 and the intermediate transfer belt 14 is 4 mm; and Condition 2: the width of the contact nip between a medium and a transfer member (the secondary transfer roller 18, the secondary transfer opposite roller 19) is equal to or greater than 4 mm, regardless of the thickness of the medium.

It is required for the fixing section 16 that the fixing on an ordinary sheet causes no high-temperature offset. As shown in FIG. 4, the fixing section 16 structurally includes a preheating area for medium. The fixing section 16 can fix a medium whose grammage is large within a temperature range in which no high temperature offset occurs on an ordinary sheet.

The proportion of the preheating area of the fixing section 16 is 17.5 mm in the example 1.

The proportion of a fixing nip 132 based on the press roller 128 and the heating roller 120 is 2.5 mm.

FIG. 6A is a diagram illustrating the condition of the volume resistivity and the resistive layer thickness of each transfer member and the product of the volume resistivity and the resistive layer thickness according to the example 1.

Figure 7A:
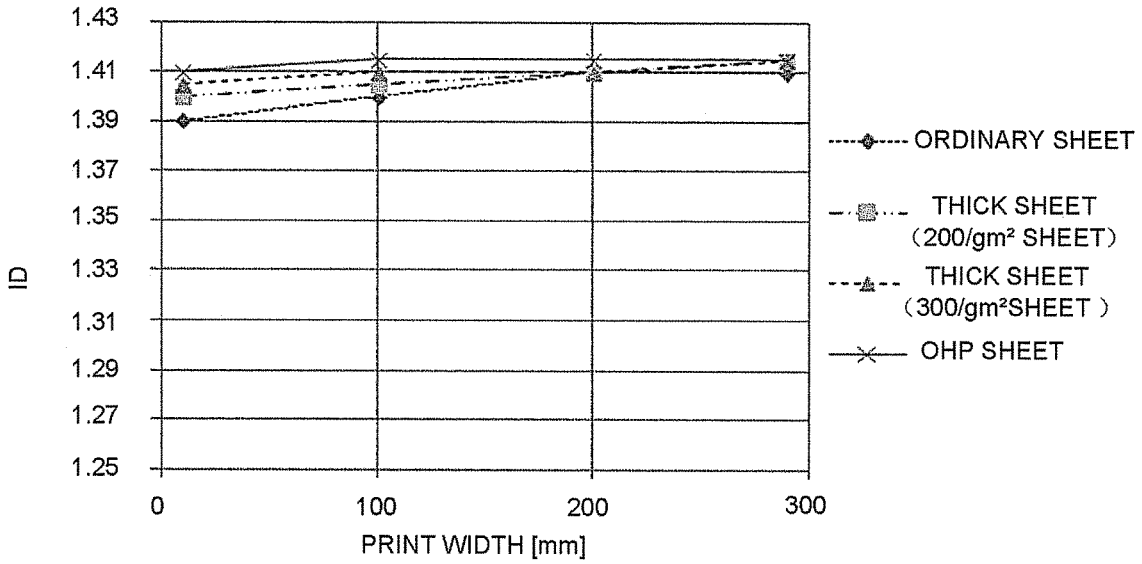
FIG. 7A is a graph illustrating the relationship between print widths of different types of image receiving media and printed image densities under the condition of the example 1.

FIG. 7A is a graph illustrating the relationship between print width for different types of media and printed image densities (ID) under the condition according to the example 1. The image density is measured using the spectrophotometer 'SpectroEye' produced by X-Rite Corporation.

Under the condition shown in FIG. 6A, in FIG. 7A, the processing speed is 50 mm/s, and the secondary transfer current is −7 μA.

FIG. 7A shows transfer performances obtained from the transfer of a toner onto the following four image receiving media: an ordinary sheet, a thick sheet having a grammage of 200 g/m$^2$, a thick sheet having a grammage of 300 g/m$^2$ and an OHP sheet. The transfer performances are represented by image densities.

It is known that even if a transfer job is carried out on each image receiving medium (a sheet, a printed medium) under the condition of a single transfer current (7 μA) and the print span of an image is reduced, an excellent transfer performance can be achieved.

The MAX voltage value used in this case is the voltage in a case of an OHP sheet, that is, −1890V, which is sufficient. The secondary transfer transformer used in the present example has the same level of capacity with a commonly used transformer because the upper limit values of the capacities of these two kinds of transformers, if represented by absolute values, are both about 6000V.

Example 2

Based on the structures shown in FIGS. 1-5, the present inventor changes the combination of resistances of transfer members to measure the resistance in the example 2. The other structures and conditions according to the example 2 are identical to those according to the example 1.

Generally, the resistance of a transfer roller changes with the environment or the power-on time.

There is a tendency that the resistance of a transfer roller decreases in a high-temperature and high-humidity environment and increases in a low-temperature and low-humidity environment.

According to mastered knowledge, the present inventor knows that the resistance of the transfer member after the secondary transfer section 15 is used for a long time increases in most cases. The long time refers to the time elapsing in a service life test conducted by powering on the secondary transfer section 15 repeatedly.

According to the result of deep discussions, the present inventor finds out that initial resistances of the transfer members are preferred to be combined as shown in FIG. 6B in a normal use environment (23° C., 50% RH). RH represents relative humidity.

FIG. 6B is a diagram illustrating the condition of the volume resistivity and the resistive layer thickness of each transfer member and the product of the volume resistivity and the resistive layer thickness according to the example 2.

The resistance value of each transfer member can be suppressed to a level identical to that shown in FIG. 6A <example 1> in a high-temperature and high-humidity environment even if the resistance of the secondary transfer roller 18 is reduced. Thus, a transfer performance at the same level with that achieved in the foregoing <example 1> is achieved even in a high-temperature and high-humidity environment.

Figure 7B:
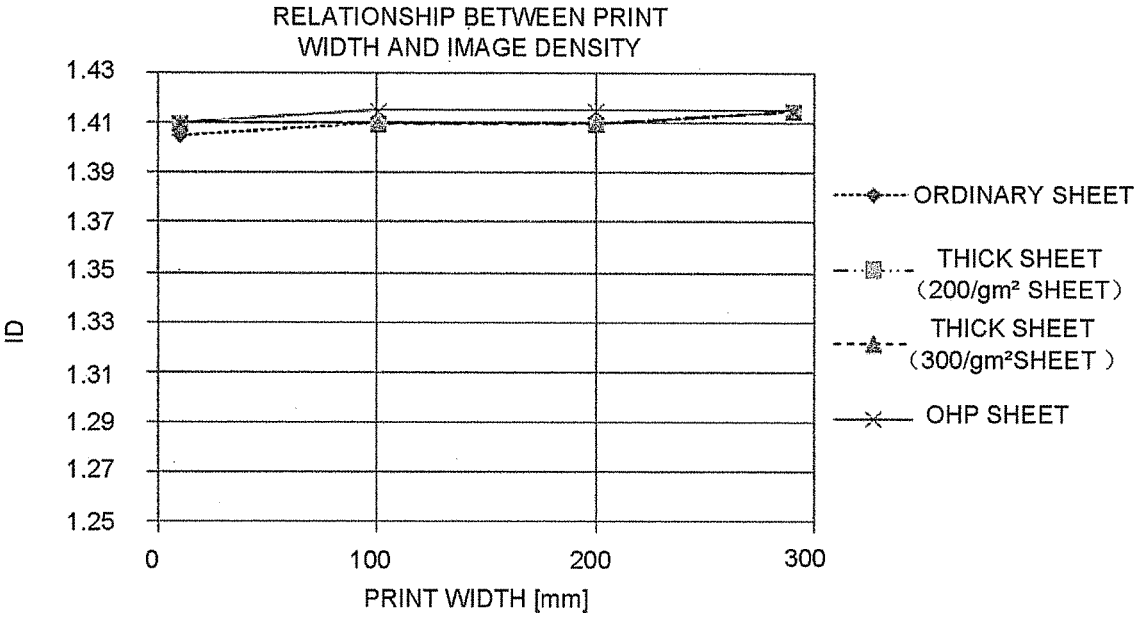
FIG. 7B is a graph illustrating the relationship between print widths of different media and printed image densities under a condition of the example 2.

FIG. 7B is a graph illustrating the relationship between print width for different media and printed image densities under a condition according to the example 2. The processing speed is 50 mm/s, and the secondary transfer current is −7 μA.

As shown in FIG. 7B, a result better than that achieved in the <example 1> is achieved in a normal use environment (23° C., 50% RH).

The result shown in FIG. 7B indicates an example of the rise in the resistance of the second transfer roller 18 serving as a second transfer member under the condition for the achievement of the result (FIG. 7A) of the <example 1>.

Thus, it can be known that by increasing the resistance of the transfer member, the effect degree of a print span and a medium on a transfer performance can be reduced.

Further, if the secondary transfer roller 18 whose initial resistance is shown in FIG. 6B is used for a long time in a low-temperature and low-humidity (10° C., 20% RH) environment, then the resistance of the secondary transfer roller 18 increases in most cases. When the resistance of the secondary transfer roller 18 increases sharply, the value of the volume resistivity of the secondary transfer roller 18 increases approximately one digit in some cases.

Consequentially, it is deemed that the volume resistivity increases from (2.1E+09 Ω·cm) to (2.1E+10 Ω·cm) due to the rise of use life and the changed environment.

(E and following numbers represent the power of 10, and the number prior to E represents a coefficient.)

The influence degree caused by a medium and a print span to a transfer performance is little as long as there is the flow of a desired current, even if the resistance increases. The desired current refers to a current the magnitude of which is enough for excellent transfer of a toner image.

However, to enable the flow of a desired current, it is required that the Max voltage value cannot be beyond the transformer capacity of a high voltage transformer (the secondary transfer constant-current transformer 12).

It is assumed in the example 2 that the resistance of a transfer member increases significantly because of a long use time and a low-temperature and low-humidity environment. In this case, if the processing speed is 75 mm/s, then the voltage required for transfer should be greater than −8000V for the flow of a current for the transfer of a toner image onto a medium.

The processing speed of 75 mm/s is the speed at which a normal electrophotographic type image forming apparatus operates. A voltage above −8000V is necessary so as to over the transformer capacity used in an ordinary transfer apparatus. Thus, the voltage above −8000V is impracticable.

The processing speed of the transfer apparatus according to the present embodiment is set to be 50 mm/s.

As a result, according to the transfer apparatus according to the present embodiment, the maximum voltage can be suppressed at about −5700V even if a current (−7 μA) needed for transfer flows. Thus, even if the resistance increases sharply, a toner image can be completely transferred onto a medium under a normal transformer capacity.

The image forming apparatus according to the present embodiment makes the mixers 102 and 103 driven independent from the magnetic roller 104. Thus, even if the intermediate transfer belt 14 carrying an image moves at a low speed, the rotation speeds of the mixers 102 and 103 can be kept, but not lowered largely.

The rotation speeds of the mixers 102 and 103 inside the developing device 11 are not reduced even if the processing speed is reduced to 50 mm/s. The stirring and conveyance of the developing agent inside the developing device 11 are continued well.

Embodiment 3

Based on the structures shown in FIG. 1-FIG. 5, the present inventor changes the combination of resistances of transfer members to measure the resistance in embodiment 3. The other structures and conditions according to the embodiment 3 are identical to those according to the example 1.

It is discussed for the present inventor in the embodiment 3 how to cope with a necessary reduction in the transformer capacity according to the <example 2>.

In the secondary transfer section 15 using the combination of the transfer members according to the <example 2>, the present inventor reduces the processing speed to 30 mm/s and the transfer current to −4 μA if the resistance of the secondary transfer roller 18 increases largely because of a long use time and a low-temperature and low-humidity environment.

Specifically, the resistance of the secondary transfer roller 18 increases from 2.1E+09 Ω·cm to about 2.1E+10 Ω·cm.

In this case, the present inventor lowers the Max voltage to about −3300V without changing the tendency of the transfer performance of each kind of medium to that shown in FIG. 7B of the <example 2>.

In the example 2, the Max voltage is the voltage of an OHP sheet passing through the secondary transfer section 15.

In the embodiments 2 and 3, if the total load resistance of the transfer members which are assumed to be increased in resistance because of a long use time and a changed environment, is represented by the sum of the products of the volume resistivities and the thicknesses of the transfer members, then the total load resistance is 1.3E+10 $\Omega\cdot cm^2$.

Figure 8A:
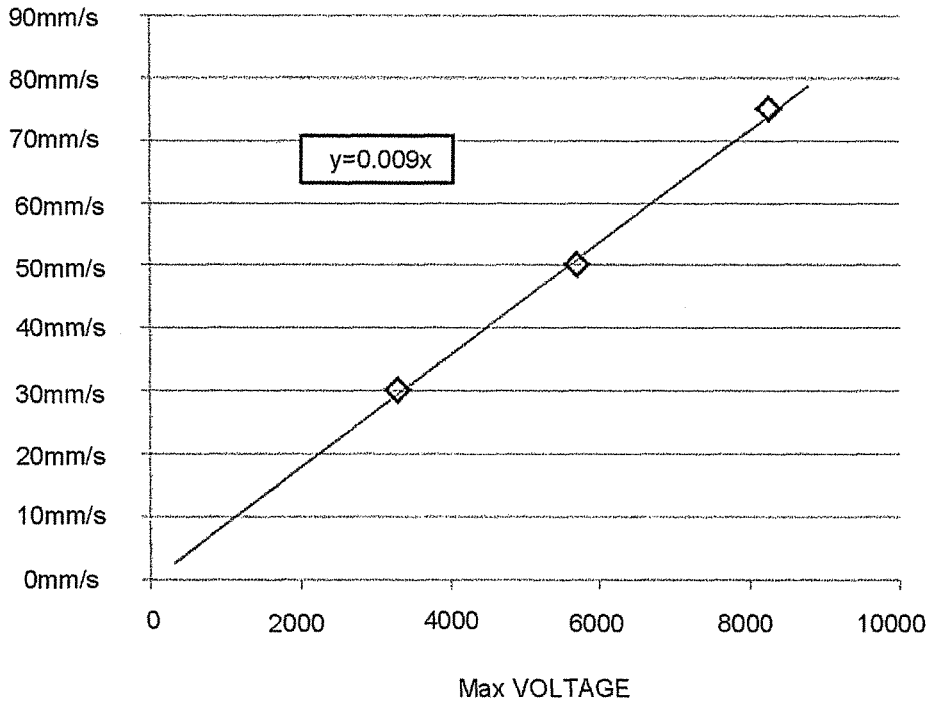
FIG. 8A is a graph illustrating the relationship between the maximum value of voltage capacity of the high voltage transformer of the transfer apparatus and the allowable processing speed according to the embodiment.

According to the result of deep discussions, the present inventor finds out that the Max voltage under this assumption and the upper limit value of the processing speed in order not to exceed the Max voltage (referred to as an allowable processing speed) meet the relationship shown in FIG. 8A.

That is, FIG. 8A is a graph illustrating the relationship between the maximum value of voltage capacity of the secondary transfer transformer and an allowable processing speed.

The present inventor finds out that the maximum value (V) of the voltage capacity of the secondary transfer transformer×0.009=allowable processing speed . . . formula (1).

For example, the voltage capacity of a secondary transfer transformer (the secondary transfer constant-current transformer 12) is set to be 6000V, which is the voltage capacity of an ordinary transformer. The following result is gotten by putting the value into the foregoing formula (1): 6000×0.009=54.

That is, according to formula (1), by making the processing speed equal to or smaller than 54 mm/s, the maximum value of voltage (V) needed for the flow of a secondary transfer current is equal to or smaller than the maximum value of voltage (V) of the transformer capacity.

Thus, according to the transfer apparatus of the present embodiment, a sufficient voltage can be obtained by making the upper limit value of the load resistance of transfer members equal to or smaller than (1.3E+10 $\Omega\cdot cm^2$) and conveying a medium at a processing speed meeting the foregoing formula (1).

Example 4

Based on the structures shown in FIG. 1-FIG. 5, the present inventor changes the combination of resistances of transfer members to measure the resistance in the example 4.

According to the structure and condition described in the <example 1>, a resistive layer having a thickness of 500 μm is arranged on the secondary transfer opposite roller 19. The diameter of the core bar of the secondary transfer opposite roller 19 is changed in such a manner that the outer diameter of the secondary transfer opposite roller 19 is 18 mm in total.

The hydrin rubber which is 500 μm thick and the volume resistivity of which is 1E10 Ω·cm is arranged on the secondary transfer opposite roller 19. The load resistance is equal to the combination of the transfer members shown in FIG. 6C.

The other structures and conditions according to the example 4 are identical to those according to the example 1.

FIG. 6C is a diagram illustrating the condition of the volume resistivity and the resistive layer thickness of each transfer member and the product of the volume resistivity and the resistive layer thickness according to the example 4.

Figure 8B:
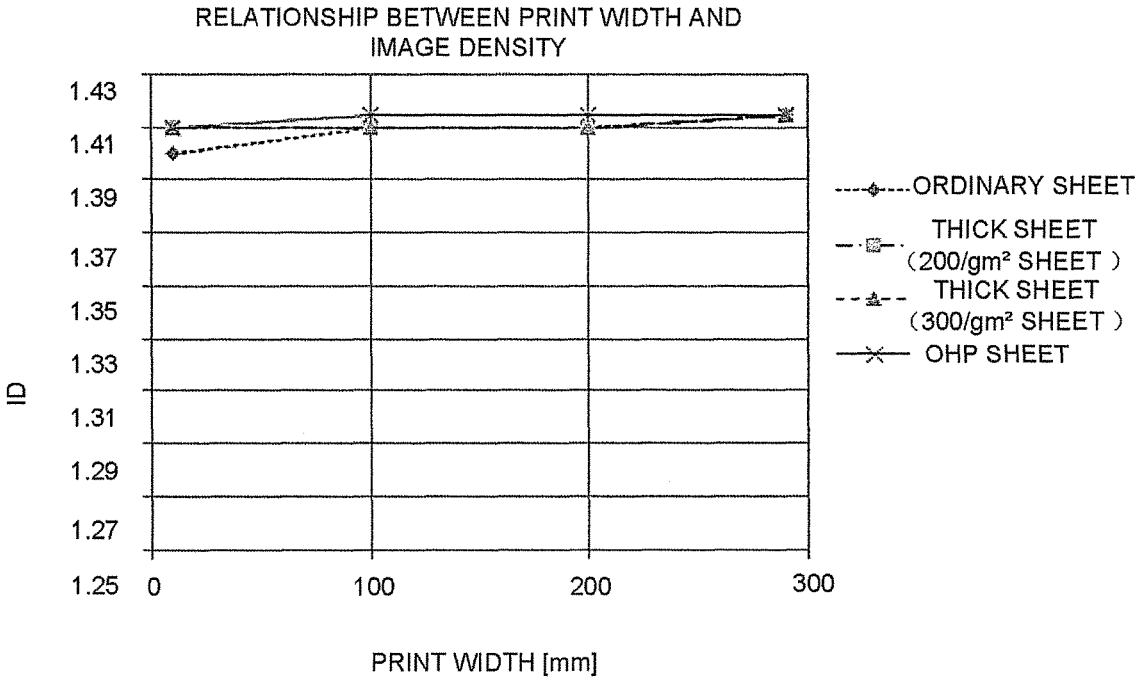
FIG. 8B is a graph illustrating the relationship between print widths for different media and printed image densities under the condition of the example 4.

FIG. 8B is a graph illustrating the relationship between print width for different media and printed image densities under the condition according to the example 4. The processing speed is 50 mm/s, and the secondary transfer current is −7 μA.

As shown in FIG. 8B, a result nearly identical to that obtained in the example 2 (FIG. 7B) can be obtained in the example 4.

As shown in FIGS. 6A and 6C, a secondary transfer roller 18 having a smaller volume resistivity than the secondary transfer roller 18 of the example 1 is used in example 4.

The secondary transfer opposite roller 19 has resistance at the side opposite to the secondary transfer roller 18 located at a secondary transfer position.

According to the result of discussions, the present inventor finds out that a little better result is achieved in the example 4 when compared with that achieved in the example 1.

Like in the examples 1-4, the transfer apparatus according to the present embodiment is capable of transferring an image onto a sheet under a single transfer condition, not influenced by the type of a medium or a print span.

(Short Summary)

In a case where the roller opposite to a secondary transfer roller is a pure conductor, the transfer current flowing towards a medium is decreased, if compared with the sharply increased current flowing towards a no-medium area during the transfer of a toner onto a medium having a print span smaller than a full-size print span adopted for a secondary transfer in an intermediate transfer system.

As a result, compared with the transfer performance when a transfer job is carried out on a full-size medium, the transfer performance when the transfer job is carried out on a medium having a smaller print span is degraded. In this aspect, the transfer of a toner based on an intermediate transfer system is different from that of a toner based on a photoconductor system.

If the size or span of a sheet is not optional, the roller opposite to the secondary transfer roller 17 may be a conductor.

The quality of the image printed by the image forming apparatus on a narrow medium may be degraded in a case where it is desired that the medium having a smaller width is printed with the maximum print span.

In this case, the image forming apparatus needs to carry out a control to increase magnitude of current for the medium having a relatively small width.

However, even by the control of the image forming apparatus, because the magnitude of current flowing in a no-medium area increases sharply, the magnitude of current is insufficient for the transfer of a toner if the current capacity of the transformer is small.

Like in the example 4, as the secondary transfer opposite roller 19 has resistance, the image forming apparatus according to the present embodiment can eliminate the degradation.

According to mastered knowledge, the present inventor knows that the number of the digits of the product value of [volume resistivity [Ω·cm] and the thickness [cm]] of a sheet medium used frequently is approximately equal to 1.0E+08.

The secondary transfer opposite roller 19 is provided with a resistive layer having a resistance indicated by a product value of [volume resistivity (Ω·cm) and the thickness (cm) of the resistive layer] having the same number of digits with (1.0E+08 [Ω·cm]). By arranging the resistive layer having this resistance value on the secondary transfer opposite roller 19, the image forming apparatus according to the present embodiment can easily prevent the occurrence of the degradation of a transfer performance on a sheet having a small width.

For the sake of references, in the example 4, the present inventor investigates the change of the image density caused by changing the resistance of the secondary transfer opposite roller 19. The resistance refer to the product of the volume resistivity (Ω·cm) and the thickness [cm) of the resistive layer.

Figure 9:
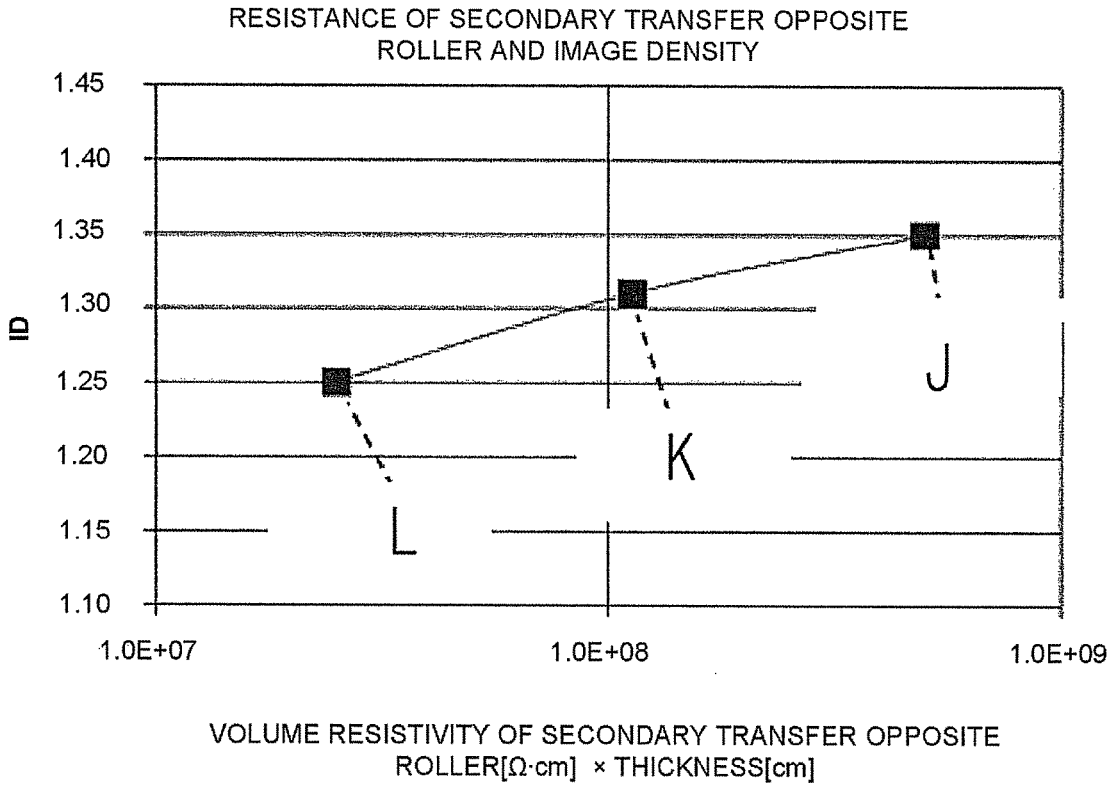
FIG. 9 is a graph illustrating the relationship between the resistance of a secondary transfer opposite roller and the printed image density under a reference condition.

FIG. 9 is a graph illustrating the relationship between the resistance of the secondary transfer opposite roller 19 and the printed image density under a reference condition. An image is printed on an OHP sheet having a small width (148 mm width).

The point J represents a result obtained under the condition according to the example 4 (the combination shown in FIG. 6C). The conditions for the resistances of the secondary transfer opposite roller indicated by the points K and L are under the following conditions (d) and (e). The other conditions for the second transfer opposite roller and the intermediate transfer belt are the same as those shown in FIG. 6C.

$$1.1E+08\ \Omega\cdot cm^2 (= \text{“volume resistivity } 2.25E+09\ \Omega\cdot cm\text{”} \times \text{“thickness } 0.05\ cm\text{”}) \quad (d)$$

$$2.5E+07\ \Omega\cdot cm^2 (= \text{“volume resistivity } 5.00E+08\ \Omega\cdot cm\text{”} \times \text{“thickness } 0.05\ cm\text{”}). \quad (e)$$

The image density is obtained every time the points J, K and L and the resistance of the secondary transfer opposite roller are reduced, then it can be known that the image density is gradually reduced as the resistance of the secondary transfer opposite roller is reduced.

If the resistance is reduced to the level represented by the point L, then it can be known by the comparison with a comparison reference (example 4) that the image density is reduced quite.

FIGS. 10A and 10B are plural table views separately indicating the results achieved by combining the elements of various transfer members.

The table views comprehensively show the result of the combination of the resistances, the thicknesses, the processing speeds and the like obtained under a condition using the combinations different from that shown in the examples 1-4.

The leftmost item represents examples 1-4 and supplemental examples 1-7. The present inventor prints the same image pattern on the same type of medium to measure the image densities in these items.

An example 2-1 is an example of the use of the secondary transfer section 15 after long-used in the example 2 in a low-temperature and low-humidity (10° C., 20%) environment (the L/L environment shown in FIG. 10A).

An example 2-2 is an example of a case in which the conveyance speed of a medium is 75 mm/s in the example 2-1.

In the example 2-2, in the case of an OHP sheet, voltage capacity exceeds the upper limit value and the transfer job fails (refer to cf3).

In the example 2-2, the absolute value of the maximum voltage is equal to or greater than 8000V (refer to cf4).

The IDs obtained by printing a 10 mm-wide printing pattern on an ordinary sheet are recorded in the column 'minimal ID' of the figure, and the ID obtained in this case is smallest.

If the image density (ID) is equal to or greater than 1.3, then it is set that the result is qualified (the symbol ○, Δ or X shown in the item 'minimal ID' represents a visually determined result).

It is set that the result is ○ when the ID is equal to or greater than 1.35.

It is set that the result is X when the ID is equal to or smaller than 1.29.

It is set that the result is Δ when the ID is between 1.30 and 1.34.

The voltage used for the solid printing on a whole surface of an OHP sheet is recorded in the column 'maximum voltage' (the voltage in this case is highest).

[Ω·cm2] represents [$\Omega \cdot cm^2$].

According to the results shown in FIGS. 10A and 10B, the inventor finds out that the transfer apparatus is applicable as long as the sum of the products of "the volume resistivities [Ω·cm] and the thicknesses [cm]" of the transfer members in the transfer apparatus is equal to or greater than $3.6\times10^8$ [$\Omega \cdot cm^2$] and the processing speed is equal to or smaller than 50 mm/s.

Example 5

The image forming apparatus according to the embodiment may adopt a transfer mode by means of which the examples 1-4 can be realized.

In this case, the image forming apparatus can print on any kind of medium without regard to the type of the medium by selecting a transfer mode in which a conveyance speed is low (equal to or smaller than 50 mm/s), as described in the embodiments 1-4.

Alternatively, the image forming apparatus can select a print at a normal print speed according to the selection of the user.

The driving for the mixers 102 and 103 of the developing device 11 of the image forming apparatus according to the embodiment is different from that for the magnetic roller 104.

The rotation speed of the magnetic roller 104 needs to keep pace with a print speed (processing speed) and is therefore necessarily changed when a switching is conducted between an ordinary print mode and a low-speed print mode. In consideration of the operability of toner supply, it is preferred that the mixers 102 and 103 are fixed in speed.

In the image forming apparatus according to the present embodiment, as the driving for the mixers 102 and 103 of the developing device 11 is different from that for the magnetic roller 104, even in a transfer mode selected corresponding to a low-speed sheet, the mixers 102 and 103 of the developing device 11 can rotate at the same speed with that in a normal print mode.

The problems relating to a toner supply control are eliminated by the image forming apparatus according to the present embodiment.

That is, the problems corresponding to the change of the characteristics of the toner sensor 105 caused by the change of the mixing speed or the change of conveyance speed of a developing agent are eliminated during a toner supply control.

SUMMARY

The key point of the smooth execution of a transfer job lies in keeping the magnitude of current flowing through each unit area of toner almost unchanged even if the type of the sheet is changed.

The use of a constant voltage system cannot keep the value of current flowing through a sheet constant because different types of sheets have different electrical physical properties or thicknesses.

In a constant voltage system, it is needed to change a voltage setting value according to each medium, and to obtain a desired magnitude of current, the transfer voltage needs to be changed for each sheet. An image forming apparatus relating to related technology is necessary to provide different modes for different types of sheets.

Contrarily, in a constant current system, a current setting value can be constant regardless of the type of the sheet.

However, in the use of the constant current system, the transfer performance is lowered when it comes to an image having a narrow print span (the span in the horizontal scanning direction).

A sheet surface includes a no-toner area and a toner-carrying area. If the proportion of the no-toner area is bigger, then the density of the current in the no-toner area is higher.

As a sheet on which an image having a small print span is carried includes a great number of no-toner areas, a transfer bias cannot be applied uniformly to the whole area of the sheet.

Thus, in the constant current system, the transfer performance is lowered when it comes to an image having a narrow print span. The transfer performance refers to the reproducibility of an image or the uniformity of image density.

Particularly, the transfer performance is lowered obviously when it comes to a color image pattern formed by overlapping two layers of different colors of toners. Therefore, it is not practical to merely adopt the constant current system.

Additionally, a method is known which increases the magnitude of current flowing through a no-toner area and a toner-carrying area of a sheet on which an image having a narrow print span is carried. The current capacity is overhigh in this method.

In the image forming apparatus according to the present embodiment, i) the secondary transfer constant-current transformer (high voltage transformer) is a constant current transformer;

ii) the sum of the products of the volume resistivities (Ω·cm) and the thicknesses (cm) of the load resistances of (the secondary transfer roller 18, the intermediate transfer belt 14 and the secondary transfer opposite roller 19) constituting the transfer apparatus is equal to or approximately greater than $3.6\times10^8$ $\Omega \cdot cm^2$; and iii) by controlling the plurality of pairs of rollers 20 and the sheet conveyance motors 212, the controller 23 makes the conveyance speed V [mm/s] of a sheet equal to or smaller than the speed calculated according to the following formula: V=A×0.009. The output upper limit value of the absolute value of the voltage output from the transfer polarity side of the secondary transfer constant-current transformer 12 is set to be A[V].

The 'transfer polarity side' refers to a polarity side for transferring the toner on the intermediate transfer belt 14 onto an image receiving medium.

According to mastered knowledge, the present inventor finds out that a proper transfer performance can be achieved without changing the condition of a transfer bias for each medium.

Moreover, according to mastered knowledge, the present inventor finds out that a transfer performance can be achieved which is suitable for a sheet on which an image having a narrow print span is carried.

Further, in the image forming apparatus according to the present embodiment, iv) the magnetic roller driving section 204 (FIG. 5) and the mixer driving section 203 are arranged separately, the controller 23 rotates the photoconductive drum 54 at a low speed below 50 mm/s; in this case, the rotation speeds of the mixers 102 and 103 (FIG. 2) are not lowered and the two-component developing agent is circulated well.

The controller 23 supplies a toner from the toner cartridge 32 to the developing device 11. In this case, the supplied toner can be mixed uniformly with the developing agent.

Further, in the image forming apparatus according to the present embodiment, v) a sheet is preheated at the upstream side of the fixing section 16;

In a relatively low-temperature area of a small-grammage sheet in which no high-temperature offset occurs, a fixing performance can be guaranteed for a large-grammage sheet such as thick sheet.

Thus, the image forming apparatus and the transfer apparatus are capable of obtaining a proper image even without changing a transfer condition for each medium.

According to the image forming apparatus and the transfer apparatus according to the present embodiment, the quality of the image formed is guaranteed even if no mode is selected by the user for a corresponding image receiving medium (sheet, printed medium).

Further, in the foregoing embodiments, a transfer member different from the intermediate transfer belt may also be used in the intermediate transfer member.

The rotation of the intermediate transfer belt 14 may be driven by the roller 69.

The structure of the image forming apparatus is not limited to these shown in FIG. 1-FIG. 5 which are merely exemplary.

The image forming apparatus described above adopts a tandem intermediate transfer system; however, the image forming apparatus may also adopt a contact transfer system. The 'contact transfer system' refers to a system in which a sheet contacts with a photoconductor during transferring process.

The speed V at which an image receiving medium is conveyed towards the secondary transfer section 15 may be equal to or smaller than 30 mm/sec.

The foregoing embodiments are merely variations devised and executed based on the transfer apparatus and the image forming apparatus disclosed herein and will not impair any advantage of the apparatus and the method.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A transfer apparatus, comprising:

a conductive intermediate transfer member that comprises an intermediate transfer belt having a product of volume resistivity [QΩcm] and thickness [cm], and transfers a toner image primarily, the product having a value of $8.4\times10^{6}$–$1.28\times10^{8}$ [QΩcm$^2$];

a transfer member configured to secondarily transfer the toner image from the intermediate transfer member onto a medium in a constant current system, the transfer member having a resistance value which increases in a low-temperature and low-humidity environment or by time elapsing;

a conveyance section configured to convey the medium between the intermediate transfer member and the transfer member; and a high voltage transformer configured to apply a bias to the transfer member, wherein, the output upper limit value of the absolute value of the voltage output from the transfer polarity side of the high voltage transformer is set to be A[V] and the conveyance speed of the medium be V[mm/s], the speed V is equal to or smaller than a speed calculated according to the following formula (i):

$$V=A\times0.009 \qquad \text{formula (i)}$$

and a processing speed corresponding to the conveyance speed is equal to or smaller than 50 mm/s and the A[V] is equal to or smaller than 5700 [V].

2. The transfer apparatus according to claim 1, wherein the transfer member comprises a secondary transfer roller and a secondary transfer opposite roller for supporting the intermediate transfer belt.

3. The transfer apparatus according to claim 2, wherein the secondary transfer opposite roller comprises a belt driving roller configured to drive the intermediate transfer belt, and a resistive layer arranged on the outer circumferential surface of the belt driving roller and configured to have a product of volume resistivity [Q≠cm] and thickness [cm] equal to or greater than $1.0\times10^{8}$ Ω·cm$^2$, a value of the volume resistivity [Ω·cm] being equal to or greater than 2.25E+09.

4. The transfer apparatus according to claim 2, wherein the width of a contact nip located between the intermediate transfer member and the transfer roller is equal to or greater than 4 mm.

5. The transfer apparatus according to claim 1, wherein a sum of products of volume resistivities [QΩcm] and thicknesses [cm] of both the intermediate transfer belt and the transfer member is equal to or greater than $1.35\times10^{9}$ Ω·cm$^2$ at 23° C. and 50% RH and further comprises a developing device including:

a developing roller in a container;

a mixer configured to circulate developer in the container; and a drive system configured to drive the mixer independently from the developing roller, the drive system keeping rotating the mixer at a speed at which the mixer is operative of continuing mixing and conveyance of the developer, and rotating the developing roller at the processing speed.

6. An image forming apparatus, comprising:

a developing device configured to form a toner image on an image carrier;

a conductive intermediate transfer member that comprises an intermediate transfer belt having a product of volume resistivity [Ω·cm] and thickness [cm], and configured to primary transfer the toner image formed by the developing device, the product having a value of $8.4\times10^{6}$–$1.28\times10^{8}$ [Ω·cm$^2$];

a transfer member configured to secondarily transfer the toner image from the intermediate transfer member onto a medium in a constant current system, the transfer member having a resistance value which increases in a low-temperature and low-humidity environment or by time elapsing;

a conveyance section configured to convey the medium between the intermediate transfer member and the transfer member;

a high voltage transformer configured to apply a bias to the transfer member; and a fixing section configured to fix the toner image on the medium, wherein the output upper limit value of the absolute value of the voltage output from the transfer polarity side of the high voltage transformer is set to be A[V] and the conveyance speed of the medium be V[mm/s], the speed V is equal to or smaller than a speed calculated according to the following formula (i):

$$V=A\times0.009 \qquad \text{formula (i)}$$

and a processing speed corresponding to the conveyance speed is equal to or smaller than 50 mm/s and the A[V] is equal to or smaller than 5700 [V].

7. The image forming apparatus according to claim 6, wherein the transfer member comprises a secondary transfer roller and a secondary transfer opposite roller for supporting the intermediate transfer belt.

8. The image forming apparatus according to claim 7, wherein the secondary transfer opposite roller comprises a belt driving roller configured to drive the intermediate transfer belt, and a resistive layer arranged on the outer circumferential surface of the belt driving roller and configured to have a product of volume resistivity [Ω·cm] and thickness [cm] equal to or greater than $1.0\times10^{8}$ Ω·cm$^2$, a value of the volume resistivity [Ω·cm] being equal to or greater than 2.25E+09.

9. The image forming apparatus according to claim 7, wherein the width of a contact nip located between the intermediate transfer member and the transfer member is equal to or greater than 4 mm.

10. The image forming apparatus according to claim 6, wherein a sum of products of volume resistivities [Ω·cm] and thicknesses [cm] of both the intermediate transfer belt and the transfer members is equal to or greater than $1.35\times10^{9}$ Ω·cm$^2$ at 23° C. and 50% RH and the developing device includes a developing roller in a container, a mixer configured to circulate developer in the container, and a drive system configured to drive the mixer independently from the developing roller, the drive system keeping rotating the mixer at a speed at which the mixer is operative of continuing mixing and conveyance of the developer, and rotating the developing roller at the processing speed.

* * * * *